US011891871B1

(12) United States Patent
Liew

(10) Patent No.: US 11,891,871 B1
(45) Date of Patent: Feb. 6, 2024

(54) MECHANICAL HANGER RUNNING TOOL WITH FLUID BEARING SYSTEM AND METHOD

(71) Applicant: Baker Hughes Oilfield Operations LLC, Houston, TX (US)

(72) Inventor: Joseph Shu Yian Liew, Singapore (SG)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/988,399

(22) Filed: Nov. 16, 2022

(51) Int. Cl.
*E21B 33/038* (2006.01)
*E21B 33/043* (2006.01)

(52) U.S. Cl.
CPC ..... *E21B 33/043* (2013.01); *E21B 33/038* (2013.01)

(58) Field of Classification Search
CPC ..... E21B 33/038; E21B 33/04; E21B 33/043
See application file for complete search history.

(56) References Cited

U.S. PATENT DOCUMENTS

| | | | | |
|---|---|---|---|---|
| 4,030,546 | A | 6/1977 | Rogers | |
| 5,443,581 | A | 8/1995 | Malone | |
| 7,530,780 | B2 | 5/2009 | Kothnur | |
| 8,276,671 | B2 * | 10/2012 | Neto | E21B 23/01 166/368 |
| 8,740,260 | B1 | 6/2014 | Liew | |
| 8,813,853 | B1 | 8/2014 | Peterson | |
| 9,217,307 | B2 * | 12/2015 | McCoy, Jr. | E21B 33/043 |
| 9,366,091 | B2 | 6/2016 | Garder | |
| 9,689,229 | B2 | 6/2017 | Hanson | |
| 10,233,710 | B2 * | 3/2019 | Nguyen | E21B 33/04 |
| 10,233,712 | B2 * | 3/2019 | Nguyen | E21B 33/04 |
| 10,851,609 | B2 | 12/2020 | Kauffmann | |
| 2002/0070545 | A1 | 6/2002 | Meek | |
| 2005/0126775 | A1 | 6/2005 | Van Nguy | |

(Continued)

FOREIGN PATENT DOCUMENTS

| | | |
|---|---|---|
| CN | 103277065 | 9/2013 |
| WO | 2013/123383 | 8/2013 |

(Continued)

OTHER PUBLICATIONS

Innovex, Mechanical Running Tool, Sep. 2021, https://www.innovex-inc.com/our-products/well-completion/liner-hangers/, 1 page.

(Continued)

*Primary Examiner* — Matthew R Buck
(74) *Attorney, Agent, or Firm* — Hogan Lovells US LLP

(57) ABSTRACT

A hanger running tool includes a mandrel. The hanger running tool also includes a mandrel protrusion, the mandrel protrusion extending radially outward from the mandrel. The hanger running tool includes a hold down nut coupled to the mandrel and arranged axially uphole of the mandrel protrusion. The hanger running tool includes a thrust collar coupled to the mandrel and arranged axially downhole of the mandrel protrusion. The hanger running tool includes a void cavity defined, at least in part, by the hold down nut, the thrust collar, and the mandrel, wherein the mandrel protrusion is positioned within the void cavity. The hanger running tool also includes a bearing system positioned within the void cavity.

19 Claims, 11 Drawing Sheets

(56) References Cited

U.S. PATENT DOCUMENTS

| | | | | |
|---|---|---|---|---|
| 2008/0210435 | A1 | 9/2008 | Goonetilleke | |
| 2011/0266006 | A1 | 11/2011 | Lacheny | |
| 2013/0048309 | A1 | 2/2013 | Young | |
| 2015/0330169 | A1 | 11/2015 | Coutts, Jr. | |
| 2017/0152721 | A1* | 6/2017 | Bories | E21B 33/047 |
| 2021/0198954 | A1 | 7/2021 | Dietrich | |
| 2021/0231105 | A1 | 7/2021 | de Souza | |

FOREIGN PATENT DOCUMENTS

| | | |
|---|---|---|
| WO | 2021/016053 X | 1/2021 |
| WO | 2021/221506 | 11/2021 |

OTHER PUBLICATIONS

Young Hong et al., "Design and analysis of an array of floating wind turbine structures," Oct. 3, 2012, The Tenth ISOPE Pacific/Asia Offshore Mechanics Symposium, Oct. 3-5, 2012, Vladivostok, Russia, pp. 5-10.

International Search Report and Written Opinion dated Aug. 11, 2023 in corresponding PCT Application No. PCT/US23/22022.

* cited by examiner

MECHANICAL HANGER RUNNING TOOL WITH FLUID BEARING SYSTEM AND METHOD

BACKGROUND

1. Field of the Disclosure

The present disclosure relates to wellbore operations. Specifically, the present disclosure relates to systems and methods for installing and hanging components in a downhole environment.

2. Description of Related Art

Oil and gas operations may be conducted in a variety of environments, such as subsea or surface environments, where components are installed on a rig or sea floor. Certain downhole components may be arranged within a wellbore and then used for several different operations, such as a drilling operation that may be followed by cementing operations, cleaning and flushing operations, installation of additional components, and others. Conventional running tools typically use hydraulic systems to generate the necessary force to set downhole tools, particularly in high pressure applications. However, the support systems for these hydraulic systems are often expensive or provide other challenges, such as difficulties with maintaining hydraulic fluid cleanliness or sourcing sufficient fluid in remote locations.

SUMMARY

Applicant recognized the problems noted above herein and conceived and developed embodiments of systems and methods, according to the present disclosure, for wellbore operations.

In an embodiment, a wellbore system includes a tubing hanger positioned within a wellhead, the tubing hanger being moveable between a locked position and an unlocked position, the tubing hanger including an activation ring and a lock ring, wherein the activation ring drives the lock ring radially outward to transition from the unlocked position to the locked position. The wellbore system also includes a hanger running tool coupled to the tubing hanger, the hanger running tool being moveable between a first position and a second position to apply an axial force to the activation ring. The hanger running tool includes a mandrel coupled to the tubing hanger, the mandrel being mechanically coupled to the tubing hanger such that rotation of the mandrel axially drives the mandrel in a downhole direction. The hanger running tool also includes a mandrel protrusion, the mandrel protrusion having a protrusion diameter larger than a mandrel diameter. The hanger running tool further includes a thrust collar coupled to the mandrel, the thrust collar being driven axially in the downhole direction responsive to movement of the mandrel. The hanger running tool includes a hold down nut coupled to the mandrel. The hanger running tool also includes a void cavity formed, at least in part, by the mandrel, the thrust collar, and the hold down nut, the void cavity positioned to receive the mandrel protrusion. The hanger running tool further includes a bearing system positioned within the void cavity, the bearing system associated with the mandrel protrusion to enable rotation of the mandrel and to accommodate axial forces applied to the mandrel.

In an embodiment, a hanger running tool for use with a wellbore system includes a mandrel having a first threaded portion at an upper end and a second threaded portion at a lower end, the second threaded portion to couple to a tubing hanger, wherein rotation of the mandrel with respect to the tubing hanger axially drives the mandrel in a downhole direction. The hanger running tool also includes a mandrel protrusion, the mandrel protrusion extending radially outward from the mandrel to a protrusion diameter that is larger than a mandrel diameter. The hanger running tool further includes a hold down nut coupled to the mandrel and arranged axially above the mandrel protrusion, the hold down nut including a profile that axially overlaps at least a portion of the mandrel protrusion and also radially surrounds at least a portion of the mandrel protrusion. The hanger running tool includes a thrust collar coupled to the mandrel and arranged axially downhole of the mandrel protrusion, the thrust collar including a recess to receive at least a portion of the hold down nut. The hanger running tool includes a void cavity defined, at least in part, by the hold down nut, the thrust collar, and the mandrel, wherein the mandrel protrusion is positioned within the void cavity. The hanger running tool also includes a bearing system positioned within the void cavity.

In another embodiment, a method includes coupling, via threaded connection, a hanger running tool to a tubing hanger to form a hanger assembly. The method also includes landing the hanger assembly in a wellhead. The method further includes rotating a mandrel of the hanger running tool, wherein rotating the mandrel causes downward movement of the mandrel along the threaded connection. The method includes driving, via the downward movement of the mandrel, a hanger lock ring radially outward to engage one or more wellbore components.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1A:
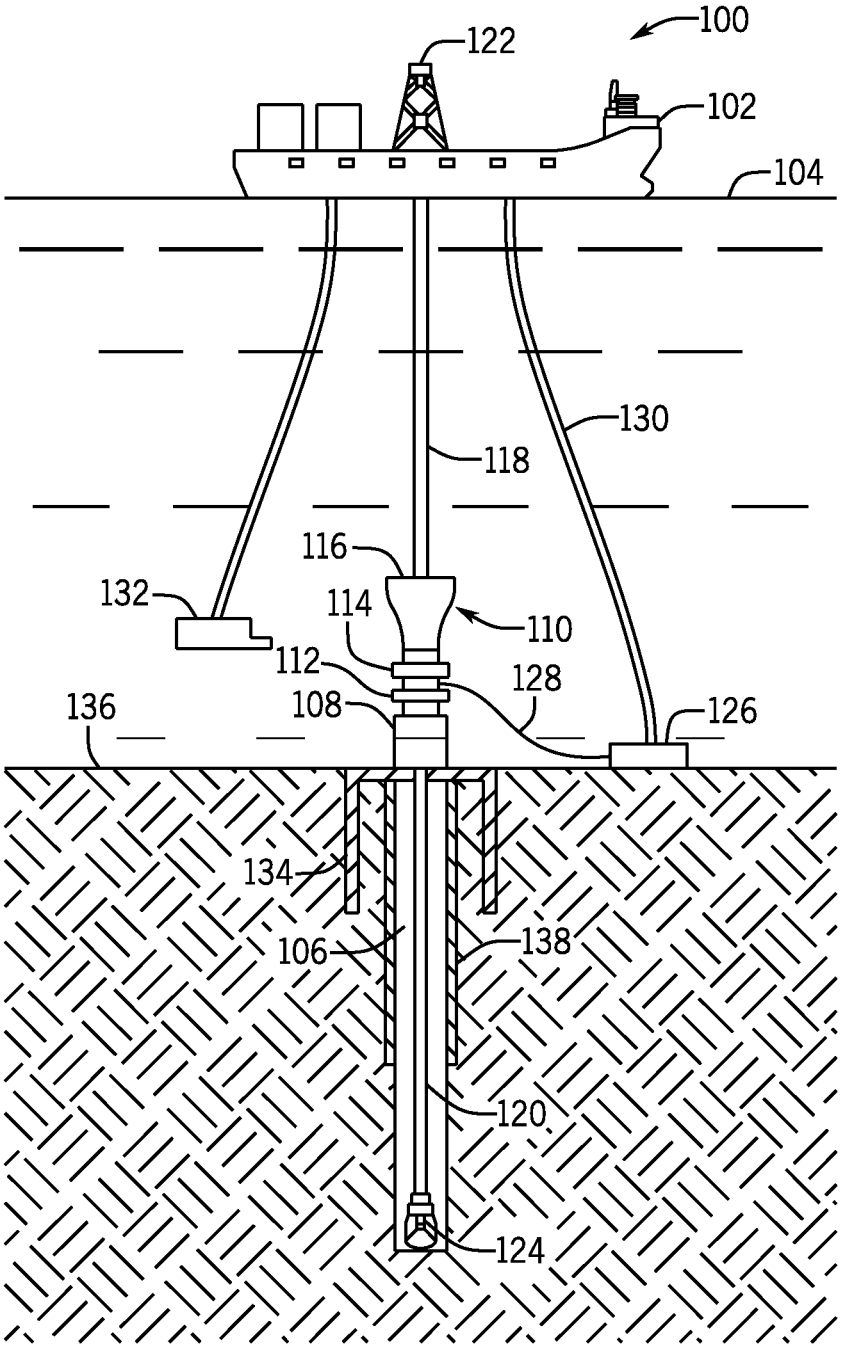
FIG. 1A is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/−10 percent.

Embodiments of the present disclosure provide systems and methods for a mechanical hanger running tool, such as a tubing hanger running tool, that incorporates one or more bearing systems. In at least one embodiment, the bearing system includes a fluid bearing. In at least one embodiment, the bearing system includes a thrust and/or mechanical bearing. Systems and methods provide a smaller and more compact design compared to conventional hydraulic tools. Furthermore, systems and methods provide for a lower cost, easier to use, and more maintenance-friendly hanger running tool. The systems and methods of the present disclosure may provide a simple to use tool that provides sufficiently high torque for use with systems that presently deploy hydraulic running tools. Various embodiments may also be used with existing systems and/or be compatible with existing systems, thereby providing for retrofits. Additionally, systems and methods eliminate hydraulic fluid associated with conventional hydraulic running tools that may be fouled and/or not easily obtained in remote locations.

Various embodiments of the present disclosure provide a mechanical running tool that is capable of transmitting a sufficient torque (as determined by system requirements and at least equal to torque capabilities of conventional hydraulic systems) using a bearing system, such as a fluid bearing system. To this end, systems and methods provide substantially equivalent results as a hydraulic running tool with a simpler, more compact arrangement that does not require hydraulics for operation. In at least one embodiment, systems and methods may be deployed by: 1. Suspending the tubing hanger at the rig floor. 2. Feeding the control lines through an anti-rotation bushing. 3. Landing the anti-rotation bushing aligning the key on the bushing with the keyway slot on the tubing hanger. 4. Picking up the mechanical tubing hanger running tool. 5. Supplying hydraulic fluid in the chambers above and below the stem of the tool through a hold down nut. In at least one embodiment, the fluid is intended to provide high bearing capability without having to consider maintenance or cleanliness of the supply. This fluid provides a cushion when the load is applied to the tool. It may be pressured above and below the mandrel to balance the stem. 6. Lowering the tubing hanger running tool over the tubing hanger. In at least one embodiment, the tubing hanger may engage on the first ten threads. There may be a number more threads to turn before the lock ring is fully energized. Ten threads is provided by way of example only and is not intended to limit the scope of the present disclosure, as more or fewer threads may be used. In at least one embodiment, the thrust collar should just touch the top of the anti-rotation bushing. In certain configurations, the lock ring may be relaxed. 7. Picking up the tubing hanger assembly and landing into the wellhead. 8. Rotating the tubing hanger running tool. This will further drive the mandrel into the tubing hanger. As the thrust collar is anchored to the mandrel, it is free to rotate but is retained in position by the retainer ring. Whilst the rotation takes place, the mandrel moves downward together with the thrust collar which in turn pushes the anti-rotation bushing further downward. The anti-rotation bushing may make contact with the top of the actuation ring, which transfers the load downward wedging the lock ring into the locking position. It should be noted that whilst the rotation takes place at a high torque due to the resistance from the metal split "C" lock ring and actuation ring, the bearing is managed by supporting the mandrel on a cushion of fluid. That fluid remains intact as it is contained with seals above and below the mandrel and thrust collar. There may also be wear rings which help to reduce the impact of the rotation and transfer of friction against metal parts. 9. Halting the rotation once the lock ring is fully radially expanded.

In this manner, systems and methods of the present disclosure provide a mechanical tool that may include a bearing system (e.g., fluid bearing, thrust bearing, roller bearing, etc.) to replace the hydraulic running tools. Systems and methods receive the benefits of using conventional running techniques and equipment make up while overcoming the drawbacks of the cost and complexity of hydraulic systems. For example, embodiments that use fluid as a bearing medium, rather than as a driving medium, may help to reduce operating loads, simplify servicing and maintaining the tools, and also reduce a number of mechanical parts. Additionally, by using a smaller, more compact tool, costs may be reduced for operators when compared to hydraulic running tools.

FIG. 1A is a side schematic view of an embodiment of a subsea drilling operation 100. It should be appreciated that one or more features have been removed for clarity with the present discussion and that removal or inclusion of certain features is not intended to be limiting, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. The drilling operation includes a vessel 102 floating on a sea surface 104 substantially above a wellbore 106. As noted, the vessel 102 is for illustrative purposes only and systems and methods may further be illustrated with other structures, such as floating/fixed platforms, and the like. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating/fixed platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Figure 1B:
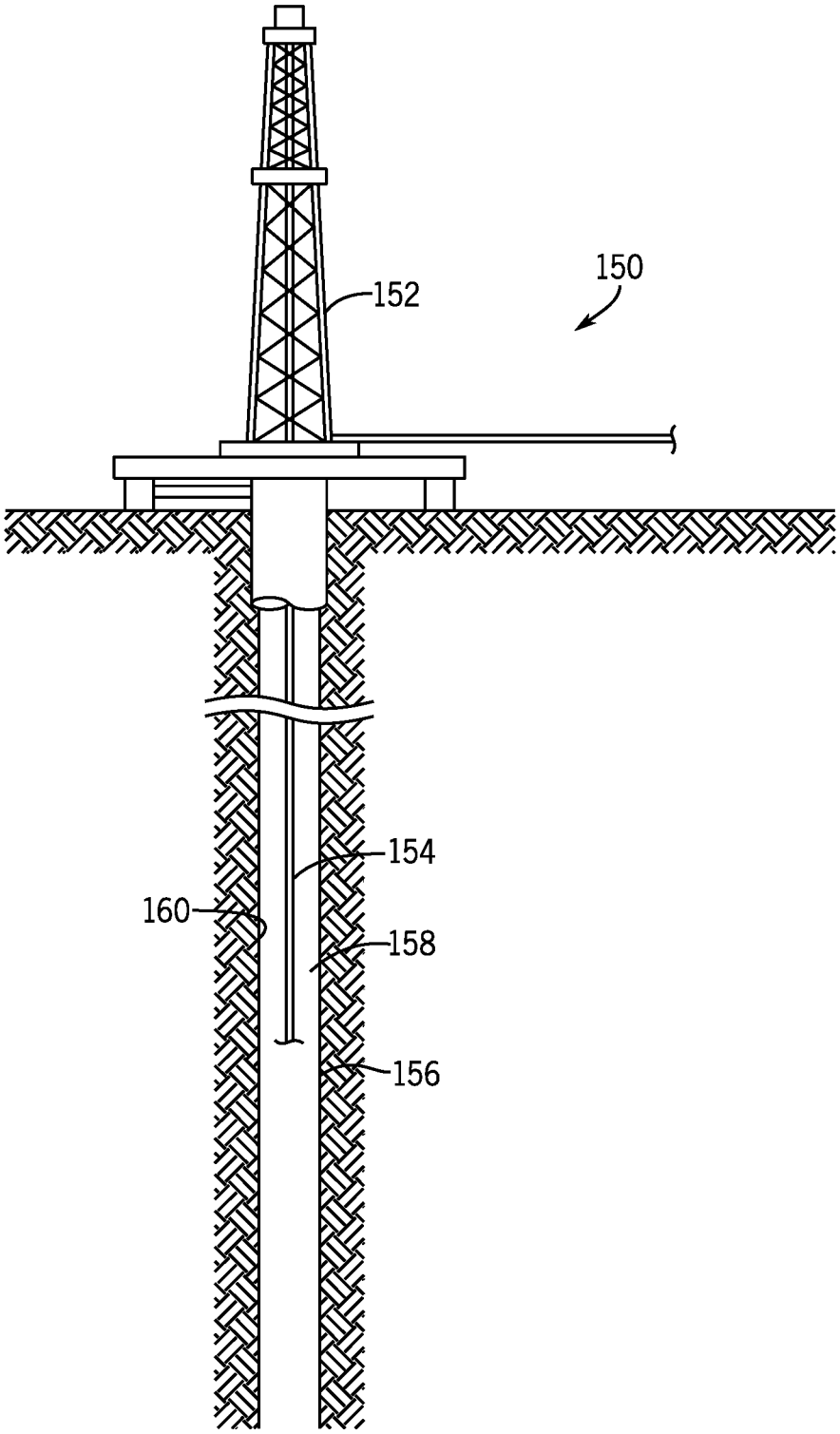
FIG. 1B is a cross-sectional side view of an embodiment of a wellbore system, in accordance with embodiments of the present disclosure.

FIG. 1B is a schematic side view of an embodiment of a wellbore system 150, which may include a completion system, a recovery system, or a drilling system. In this example, the wellbore system 150 a rig 152 and a string 154 coupled to the rig 152. The string 154 may extend through a wellhead assembly (not pictured) such as a blowout preventer (BOP) and/or one or more valve configurations. The wellhead assembly may be a surface assembly, which is not visible in the illustrated embodiment due to a platform of the rig 152, but it should be appreciated that it may be provided in various embodiments. Systems and methods may be utilized in embodiments where one or more completion or recovery operations are initiated, such as when the string 154 is suspended into a wellbore 156. In this example, the string 154 may be a completion or production string, which may include one or more tubulars coupled together and suspended from one or more features, such as the wellhead assembly and/or a casing/tubing hanger, among other options. It should be appreciated that the string 154 may also be a casing string, where one or more cementing operations may be used to cement and secure the string 154 to a wellbore wall. Furthermore, various embodiments may also implement such configurations during drilling operations, where the string 154 includes a drill bit at an end.

In this example, the string 154 is suspended into an annulus 158 formed between the string 154 and a wellbore wall 160. The string 154, as noted above, may be secured to one or more assembly that are configured to receive and support the string 154, such as a hanger assembly. In operation, the hanger assembly may be arranged within the wellbore 156, or at a surface location, and may include one or more seals to control pressure within the wellbore.

Embodiments of the present disclosure may be incorporated with one or more of exploration, drilling, completion, and/or recovery efforts associated with subsea and/or surface applications. In at least one embodiment, a mechanical system is incorporated into a hanger running tool to replace a conventional hydraulic system. The mechanical system may include one or more bearing systems, such as a fluid blearing or a thrust bearing, among other options. The bearing system may be particularly selected to accommodate the high axial loads that may be experienced within the wellbore. In various embodiments, one or more lock dogs may be incorporated into the system to receive pressure from below (e.g., wellbore pressure that drives the hanger in a direction out of the wellbore and toward a surface location) along with a ring to hold back pressure. In operation, an actuation sleeve (e.g., actuation ring, activation ring, etc.) may be used to drive the dogs in an outward direction. Typical systems may use a hydraulic tool in order to engage the dogs. However, embodiments of the present disclosure provide for a mechanical tool that can generate sufficient pressure to engage the dogs using a smaller, more compact, and easier to maintain system.

Various embodiments of the present disclosure incorporate one or more running tools that generate a vertical force (e.g., a force that drives the hanger in a direction into the wellbore and away from a surface location) using a rotational or torsional force application. In at least one embodiment, one or more sets of threads may be engaged to drive a thrust sleeve and/or activation sleeve into a downhole direction. These systems may replace typical hydraulic tools. Various embodiments use a bearing system, that may include a fluid bearing or one or more mechanical bearings, to replace such hydraulic tools as a bearing member. For example, the fluid bearings may be arranged to be substantially equal in thickness in an uphole and downhole direction in order to prevent metal-to-metal contact between various components, as described herein. The fluid bearings may be filled and then sealed to block leakage of bearing fluid while also pressurizing the system. Furthermore, the fluid bearing may also provide corrosion resistance.

Figure 2A:
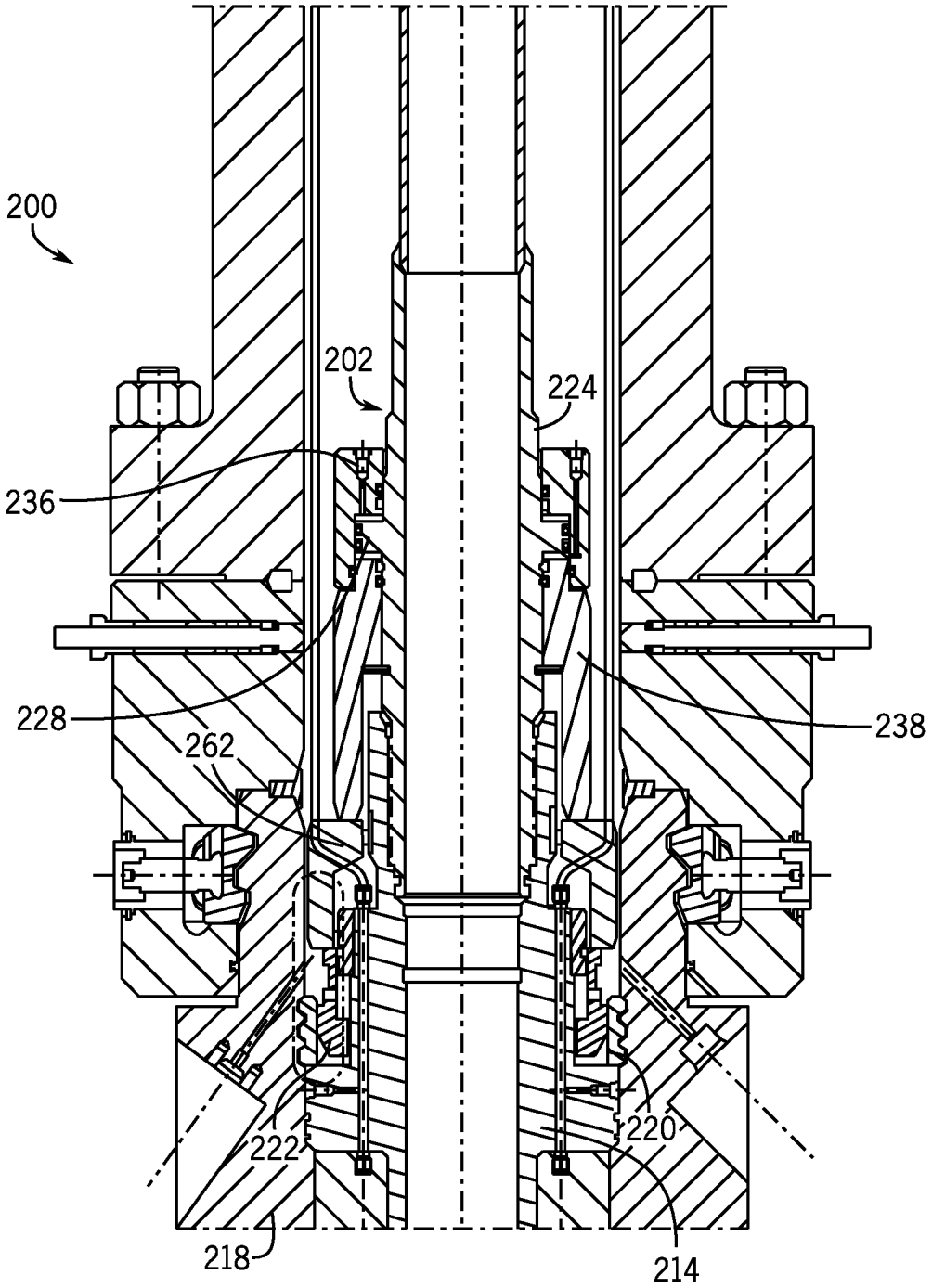
FIGS. 2A and 2B are schematic cross-sectionals view of an embodiment of a hanger assembly associated with a wellbore system, in accordance with embodiments of the present disclosure.
Figure 2B:
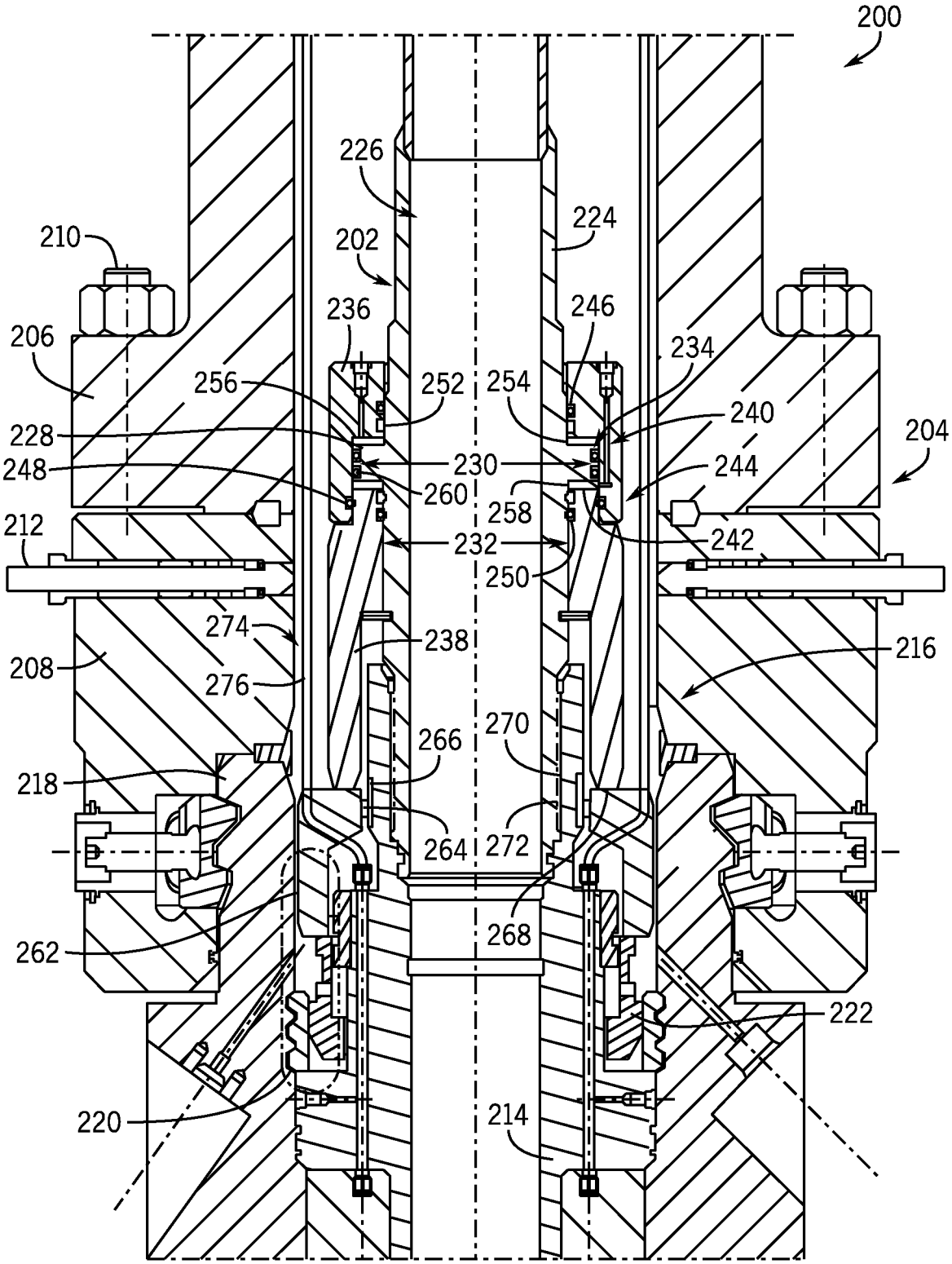

FIGS. 2A and 2B are cross-sectional views of an embodiment of a wellbore system 200 in which a hanger running tool 202 is positioned within a wellhead 204. As will be described below, FIG. 2A illustrates an uninstalled position and FIG. 2B illustrates an installed position. Turning to FIG. 2B, in this example, the wellhead 204 includes an upper head section 206 and a lower head section 208 coupled together via one or more fasteners 210. Furthermore, in this example, pins 212 extend through the lower head section 208, which may be used to grip or otherwise secure one or more features within the lower head section 208.

In this example, a tubing hanger 214 is positioned within a bore 216 of the wellhead 204. As shown, the tubing hanger 214 is arranged within a tubing head 218, for example, positioned to engage one or more shoulders, to permit hanging or securing of a tubular to extend further into the wellbore. In operation, the tubing hanger 214 is supported within the tubing head 218 by a lock ring 220 that is driven to extend radially outward and engage the tubing head 218. In at least one embodiment, the lock ring 220 may include grooves or features that engage corresponding grooves or features of the tubing head 218. During installation, the lock ring 220 does not extend out beyond the bore 216, thereby permitting movement of the tubing head 218 through the bore 216 to the tubing head 218. However, once positioned at a predetermined location, it is desirable to engage the lock ring 220 to secure the tubing hanger 214 within the tubing head 218.

In at least one embodiment, the tubing hanger 214 is installed using the hanger running tool 202. For example, the hanger running tool 202 may be used to trip the tubing hanger 214 into the wellbore, to position the tubing hanger 214 at a predetermined location, and then to apply an axial force to the tubing hanger 214 to set the lock ring 220, as shown between FIGS. 2A and 2B. The lock ring 220 may be set by an activation ring 222 that receives an axial force from the hanger running tool 202. For example, the force applied to the activation ring 222 may drive the activation ring 222 in a radially outward direction, which may cause one or more surfaces of the activation ring 222 to engage and drive the lock ring 220 in a radially outward direction, thereby securing the lock ring 220 within the tubing head 218. For example, as shown between FIGS. 2A and 2B, the activation ring 222 is moved radially inward of the lock ring 220, which transitions outwardly to engage the tubing head 218.

The illustrated hanger running tool 202 includes a mandrel 224 (e.g., body, carrier, etc.) that may be coupled to one or more running extensions for tripping the mandrel 224 into and out of the wellbore. In this example, the mandrel 224 may be threaded to the running extension, for example at a surface location. The mandrel 224 extends axially and includes a mandrel bore 226 that has a smaller diameter than the bore 216.

The mandrel 224 includes a mandrel protrusion (e.g., radial extension, force application feature, arm, ring, etc.) that extends radially outward such that a protrusion diameter 230 is greater than a mandrel diameter 232. In at least one embodiment, the mandrel protrusion 228 is an integral portion of the mandrel 224. The mandrel protrusion 228 are arranged within a void cavity 234 formed, at least in part, by a hold down nut 236 and a thrust collar 238. In at least one embodiment, the void cavity 234 may be part of at least a portion of a bearing system 240, which will be described herein, may include a fluid bearing, mechanical bearing, or combinations thereof.

In at least one embodiment, the mandrel 224 extends through a thrust collar bore and is arranged so that the mandrel protrusion 228 overlaps or otherwise is positioned over a thrust collar shelf 242. As shown in FIG. 2B, the mandrel protrusion 228 overlapping the thrust collar shelf 242 positions the mandrel protrusion 228 axially higher (e.g., axially closer to the surface, uphole, etc.) than the thrust collar shelf 242 such that at least a portion of the thrust collar shelf 242 is directly below at least a portion of the mandrel protrusion 228.

Additionally, the hold down nut 236 is shown to be positioned to both overlap the mandrel protrusion 228 as well as be positioned radially outward of the mandrel protrusion 228. The hold down nut 236 (or at least portions thereof) extends into a recess 244 formed in the thrust collar 238. In this example, the recess 244 is proximate the thrust collar shelf 242 such that the hold down nut 236 is radially outward from the thrust collar shelf 242. As a result, the mandrel protrusion 228 is positioned within the void cavity 234 that bounds or otherwise restricts the mandrel protrusion 228 by the hold down nut 236 at both an axially upward and radially outward position and by the thrust collar 238 at an axially downward position. In other words, upward movement (e.g., uphole movement, movement toward a surface location, etc.) is blocked by the hold down nut 236. Similarly, radial movement of the mandrel protrusion 228 is blocked by the hold down nut 236. Additionally, downward movement (e.g., downhole movement, movement away from the surface location, movement toward the lock ring 220, etc.) is blocked by the thrust collar 238.

In this example, seals are used to isolate or otherwise seal the void cavity 236 from the surrounding environment. For example, different annular seals may be used to block fluid ingress into the void cavity 236 or to block fluid egress from the void cavity 236. A first seal 246 may correspond to a seal between the hold down nut 236 and the mandrel 224. A second seal 248 may correspond to a seal between the hold down nut 236 and the thrust collar 238. A third seal 250 may correspond to a seal between the mandrel 224 and the thrust collar 238. It should be appreciated that there may be more or fewer seals. Additionally, wipers or wear rings may also be utilized, such as the wear rings 252, which are shown positioned at different locations along the thrust collar 238 and hold down nut 236. The wear rings 252 may center or otherwise support the components and reduce friction.

The void cavity 236 may be filled with a fluid that acts as a fluid bearing to center or otherwise position the mandrel protrusion 228 such that the mandrel protrusion 228 does not come into contact with the hold down nut 236 and/or the thrust collar 238. For example, a fluid thickness may be formed between the mandrel protrusion 228 (e.g., an upper ring surface 254) and the hold down nut 236 (e.g., a downward hold down nut surface 256). Similarly, a fluid thickness may be formed between the mandrel protrusion 228 (e.g., a lower ring surface 258) and the thrust collar 238 (e.g., the thrust collar shelf 242). Accordingly, forces from either an upward or downward location will be transmitted, via the mandrel protrusion 228, to the fluid thickness to maintain balance between the components and to block the mandrel protrusion 228 from contacting the respective thrust collar 238 and/or hold down nut 236. In at least one embodiment, a protrusion seal 260 is arranged at a radially outward position of the mandrel protrusion 228 to block fluid from flowing between a top side and a bottom side, as described herein.

In this example, an anti-rotation bushing 262 is secured to the tubing hanger 214 via an anti-rotation key 264 that engages an anti-rotation keyway 266 (e.g., slot) of the tubing hanger 214. In certain embodiments, the anti-rotation bushing 262 is installed at an uphole location and then lowered into the wellbore during installation along with the tubing hanger 214. The mandrel 224 is positioned to extend, at least in part, into the tubing hanger 214 such that the thrust collar 238 is positioned to engage the anti-rotation bushing 262. For example, the thrust collar 238 may be positioned onto an activation surface 268 of the anti-rotation bushing 262. Rotation of the mandrel 224 may then drive downward movement of the thrust collar 238, which is attached to the mandrel 224, as the mandrel 224 advances downward along a set of threads 270. In this example, the threads 270 are formed within the tubing hanger 214 and engage mating threads 272 of the mandrel 224. These threads 268 may be used for both suspending the tubing and driving in the mandrel 224. Accordingly, the mechanical force is transmitted to the activation ring 222, via the anti-rotation bushing 262, which moves in a downward direction to engage and set the lock ring 220. In this manner, the tubing hanger 214 may be set without the use of conventional hydraulic setting tools.

Various embodiments of the present disclosure may further provide for additional feature to facilitate wellbore operations, such as control of one or more valves, among other options. For example, a bypass 274 may be positioned within the anti-rotation bushing to permit a control line 276 to pass through the tubing hanger 214. As a result, control fluid may be used for downhole valves, among other options.

As described herein, systems and methods provide a mechanical running tool (e.g., the hanger running tool 202) to provide high torque and high thrust using a bearing system 240, such as a fluid bearing system and/or a mechanical bearing system. Various embodiments include the mandrel 224 for transferring axial and tensional loads via rotation into the tubing hanger 214, for example using the threads 270, 272. The mandrel 224 includes the mandrel protrusion 228 positioned within the void cavity 234 that is filled with fluid (for a fluid bearing system) or includes one or more mechanical bearings. Coupled to the mandrel 224 in the illustrated example are the hold down nut 236 and the thrust collar 238. In operation, the mandrel 224 may transmit force to the thrust collar 238, which further transmits the force to the activation ring 222, via the anti-rotation bushing 262, that drives the lock ring 220 radially outward, thereby setting the tubing hanger 214 without the use of a hydraulic setting tool.

Figure 3A:
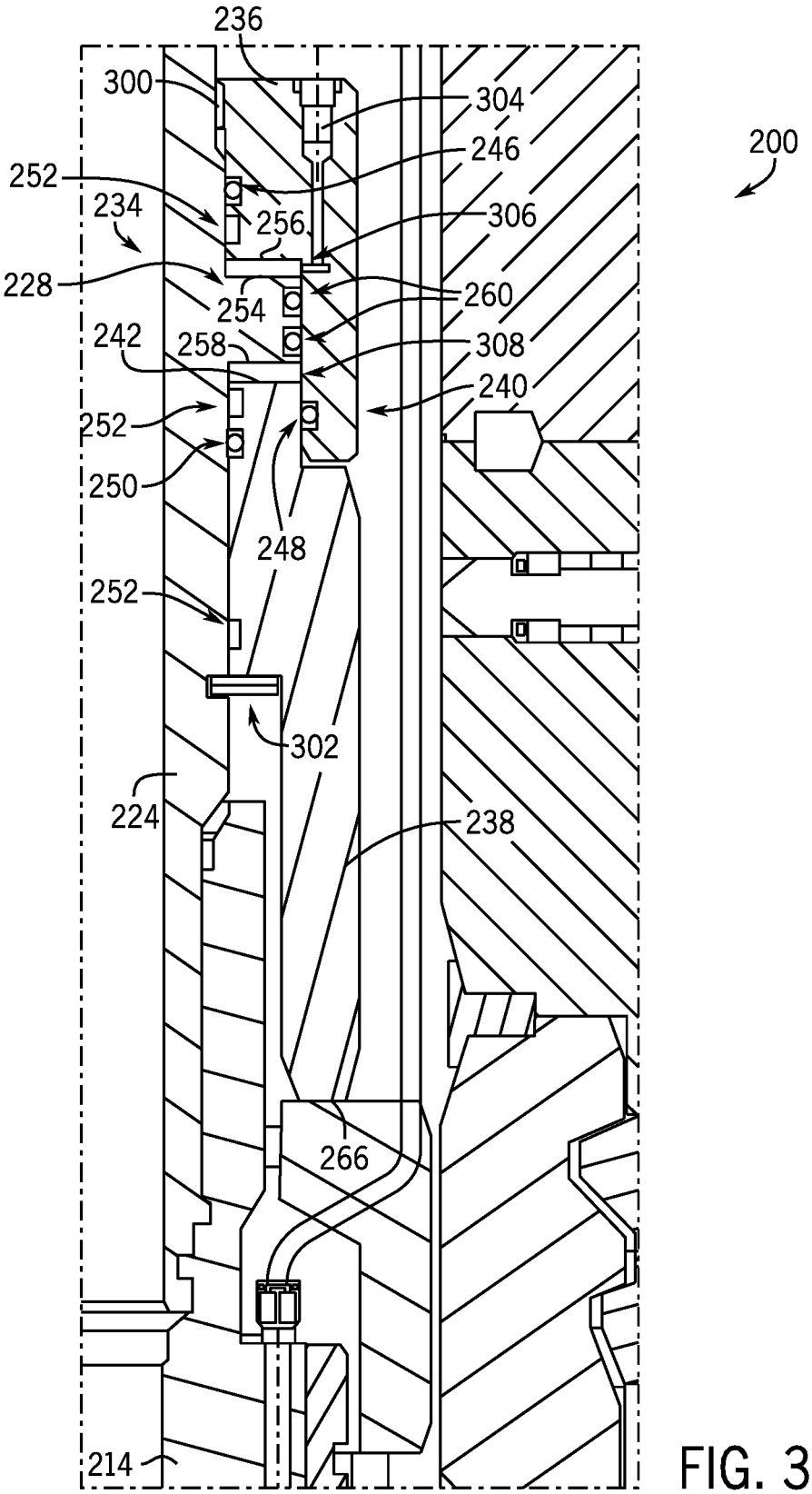
FIG. 3A is a detailed cross-sectional view of an embodiment of a hanger assembly including a fluid bearing, in accordance with embodiments of the present disclosure.

FIG. 3A is a detailed cross-sectional view of an embodiment of the wellbore system 200. In this example, the mandrel 224 is shown positioned within at least a portion of the tubing hanger 214 such that the thrust collar 238 has engaged the surface 266 of the anti-rotation bushing 274. As shown, a hanger assembly may include at least the hanger running tool 202 (e.g., the mandrel 224, the hold down nut 236, and the thrust collar 238) along with the anti-rotation bushing 262 and the tubing hanger 214 (which may also include the lock ring 220 and activation ring 222). For example, the hold down nut 236 may be coupled to the mandrel 224, such as via threads 300, as shown in FIG. 3A. It should be appreciated that other coupling devices may be used within the scope of the present disclosure and threads are provided by way of example only. Additionally, in this example, the thrust collar 238 is also coupled to the mandrel 224 via a retainer ring 302. For example, the retainer ring 302 maintains an axial position of the thrust collar 238 with respect to the mandrel 224 such that downward movement of the mandrel 224 is translated to the thrust collar 238.

As noted herein, various embodiments include a bearing system 240, which in this example is a fluid bearing system including the void cavity 234 formed, at least in part, by the hold down nut 236, the thrust collar 238, and the mandrel 224 that receives the mandrel protrusion 228. The void cavity 234 may be filled, at least partially, with a fluid, such as a hydraulic fluid, which may be transmitted into the void cavity 234 via a supply port 304. In at least one embodiment, the void cavity 234 may be presented as including an upper fill area 306 and a lower fill area 308, where the upper fill area 306 represents the space between the upper protrusion surface 254 and the downward hold down nut surface 256 and the lower fill area 308 represents the space between the lower protrusion surface 258 and the thrust collar shelf 242. In at least one embodiment, a thickness may be formed within the respective areas 306, 308 that blocks contact between the mandrel protrusion 228 and the thrust collar 238 and the hold down nut 236. In at least one embodiment, the respective areas 306, 308 (and their thicknesses) may be substantially equal. However, it should be appreciated that one thickness may be greater than the other. In certain embodiments, the protrusion seals 260 may block fluid movement between the upper fill area 306 and the lower fill area 308. But various embodiments may permit flow, at least in part, such that the thicknesses may be adjusted during operations.

As noted herein, the void cavity 234 may be considered to be a sealed cavity due, at least in part, to the first seal 246, the second seal 248, and the third seal 250. Accordingly, the fluid may be added to the void cavity 234 prior to installation and arrival at the wellsite. For example, the void cavity 234 may be filled and at least portions of the hanger running tool 202 may be assembled prior to shipment to the well site. Using this process may reduce a likelihood of contamination of the fluid and/or provide for simplified operations at the well site, as the operator will not have to undergo the assembly process.

Embodiments of the present disclosure may be directed toward reducing an overall length or size of the hanger running tool 202. To that end, a void cavity size may be particularly selected to maintain a clearance between the mandrel protrusion 228 and the respective surfaces (e.g., surface 256 and shelf 242) while also reducing an overall size of the void cavity 234. In at least one embodiment, the size of the void cavity 234 may be particularly selected based, at least in part, on a mandrel size. For example, the void cavity 234 may be sized to maintain a predetermined thickness around the mandrel protrusion 228. In other embodiments, the void cavity 234 is based on expected operating conditions. In at least one embodiment, the respective areas 306, 308 have a thickness of approximately ¼ inch. This sizing is, however, provided by way of non-limiting example and is not intended to limit the scope of the present disclosure.

In various embodiments, the use of a fluid bearing reduces friction associated with the rotation of the mandrel 224, thereby requiring less force to engage the activation ring 222 and to set the hanger 214. However, mechanical bearing systems may also be utilized with low friction that can be used in place of the fluid bearing. Moreover, mechanical bearings may also be used within the void cavity 234 to reduce a likelihood of fouling or ingress that could cause friction. Additionally, in various embodiments, combinations of mechanical and fluid bearings may be used, for example, by using ball bearings that are coated in a thin film of oil to reduce friction, among various other options.

Figure 3B:
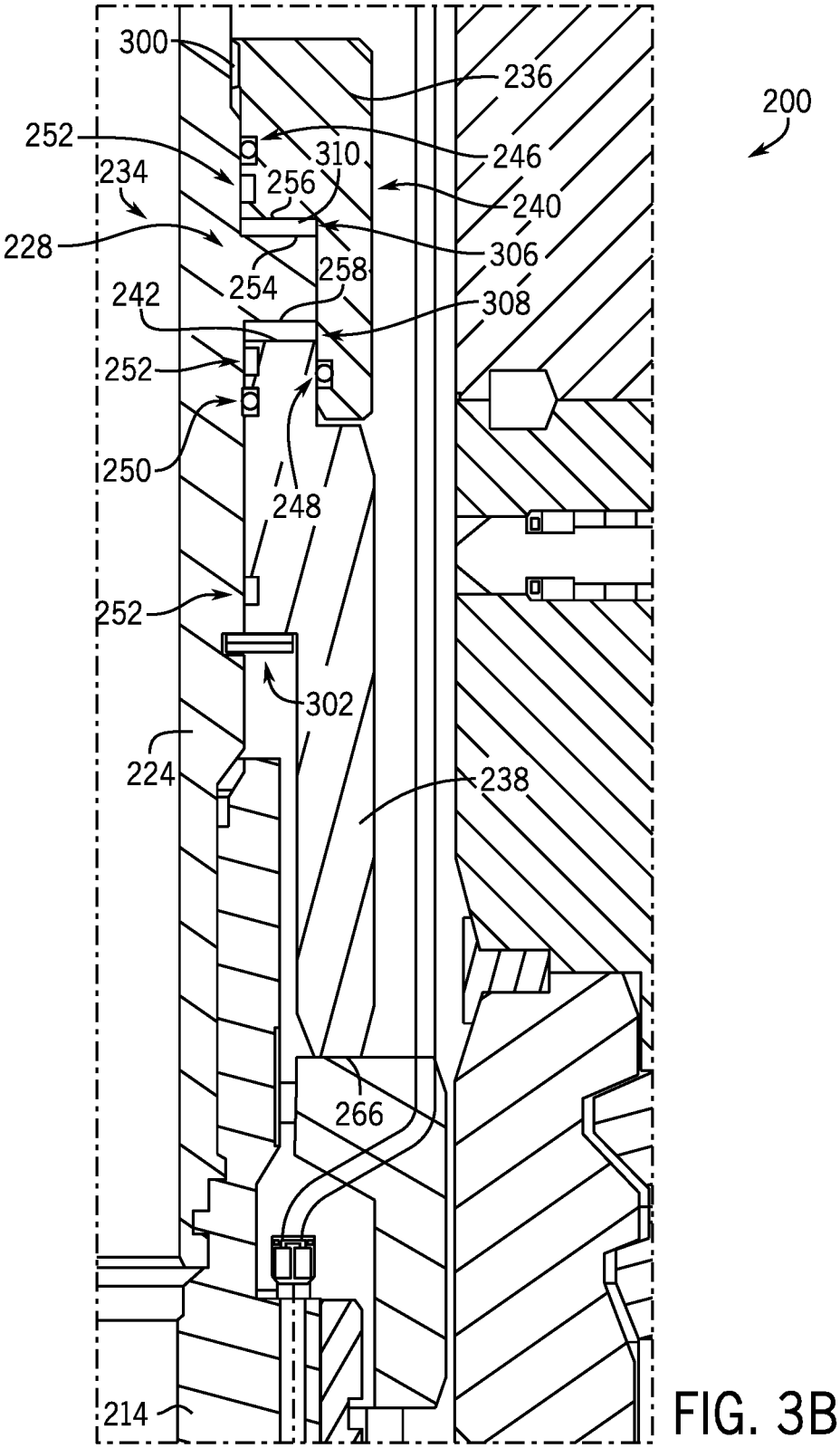
FIG. 3B is a detailed cross-sectional view of an embodiment of a hanger assembly including a mechanical bearing, in accordance with embodiments of the present disclosure.

FIG. 3B is a detailed cross-sectional view of an embodiment of the hanger running tool 202 in which the fluid bearing is replaced by a mechanical bearing, such as a thrust bearing. It should be appreciated that various components between FIGS. 3A and 3B are shared and will not be repeated for the sake of conciseness. In this example, it can be seen that the supply port 304 is no used due to the removal of the fluid bearing in place of mechanical bearings 310 that are arranged within the areas 306, 308. In at least one embodiment, the mechanical bearings 310 are thrust bearings. As shown, the void cavity 234 is still sealed via the seals 246, 248, 250 to block contaminants or otherwise block access to the mechanical bearings 310, thereby increasing reliability of the system. In operation, much like with the fluid bearing, the bearing system 240 permits rotation of the mandrel 224 in order to engage the threads of the hanger 214 to drive the lock ring 220 into an expanded position.

Figure 4:
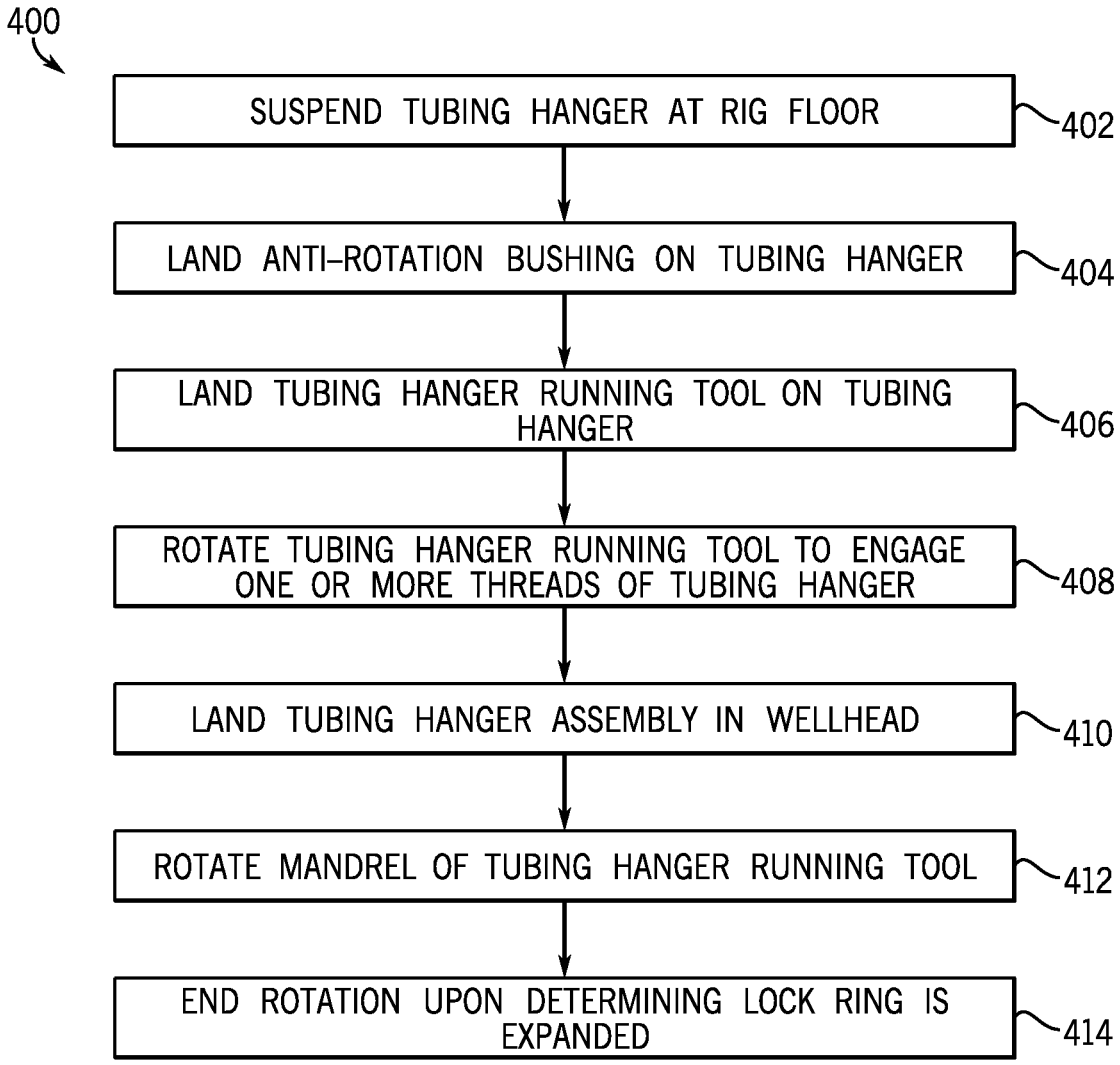
FIG. 4 is a flow chart of an embodiment of a method for hanging a tubing hanger using a hanger running tool, in accordance with embodiments of the present disclosure.

FIG. 4 is a flow chart of an embodiment of a method 400 for installing a tubing hanger using a hanger running tool. It should be appreciated that for this method, and all methods described herein, that there may be more or fewer steps or operations. Furthermore, steps may be performed in a different order, or in parallel, unless otherwise specifically stated. Additionally, different portions of the method may be conducted in uphole or downhole locations, on site or off site, or combinations thereof. In this example, a tubing hanger is suspended at a rig floor 402. For example, the tubing hanger may be prepared for installation within a tubing head. As noted herein, preparation may take place for either on-shore or off-shore operations. In at least one embodiment, an anti-rotation bushing is landed on the tubing hanger 404. The anti-rotation bushing may be positioned such that a key on the bushing is aligned with a keyway slot on the tubing hanger. In at least one embodiment, the anti-rotation bushing may include one or more passages or channels to permit control lines to extend through the anti-rotation bushing and past the tubing hanger, which may be used to control one or more downhole valves.

A tubing hanger running tool may be landed on the tubing hanger 406. In various embodiments, this operation is conducted outside of the wellbore. For example, at the rig floor, the tubing hanger running tool may engage one or more threads associated with the tubing hanger 408. In certain embodiments, such as those where the tubing hanger running tool includes a fluid bearing, fluid may be added to a void cavity prior to or after the tubing hanger running tool engages the tubing hanger. However, it should be appreciated that the void cavity may come pre-filled. The tubing hanger running tool may then engage threads of the tubing hanger by rotating one or both of the tubing hanger running tool (or portions thereof, such as a mandrel) or the tubing hanger. In at least one embodiment, a predetermined number of threads may be engaged and one or both of the tubing hanger running tool or the tubing hanger may be marked or otherwise include indicators associated with engagement of the threads. In various embodiments, thread pitch may be particularly selected to facilitate force transmission.

The tubing hanger and tubing hanger running tool may form a tubing hanger assembly that is then landed into the wellhead 410. Once landed, the tubing hanger running tool (or portions thereof) may be rotated to drive the mandrel into the tubing hanger 412. As noted herein, the tubing hanger running tool may include a thrust collar anchored to the mandrel. When rotation takes place, the mandrel moves in a downward direction along with the thrust collar, which in turn pushes the anti-rotation bushing in a downward direction. This force may then be translated to an activation ring, which moves downward to drive a lock ring in a radially outward direction to engage a tubing head. In at least one embodiment, the rotation of the mandrel takes place at a high torque due to the resistance from the lock ring, which may be a metal spilt C lock ring. However, the use of a fluid bearing, or a mechanical bearing in certain embodiments, provides a cushion for the mandrel. Rotation of the mandrel is then ended upon determining the lock ring is expanded 414. From there, the hanger running tool may be disengaged and removed from the wellbore and additional operations may commence.

Figure 5A:
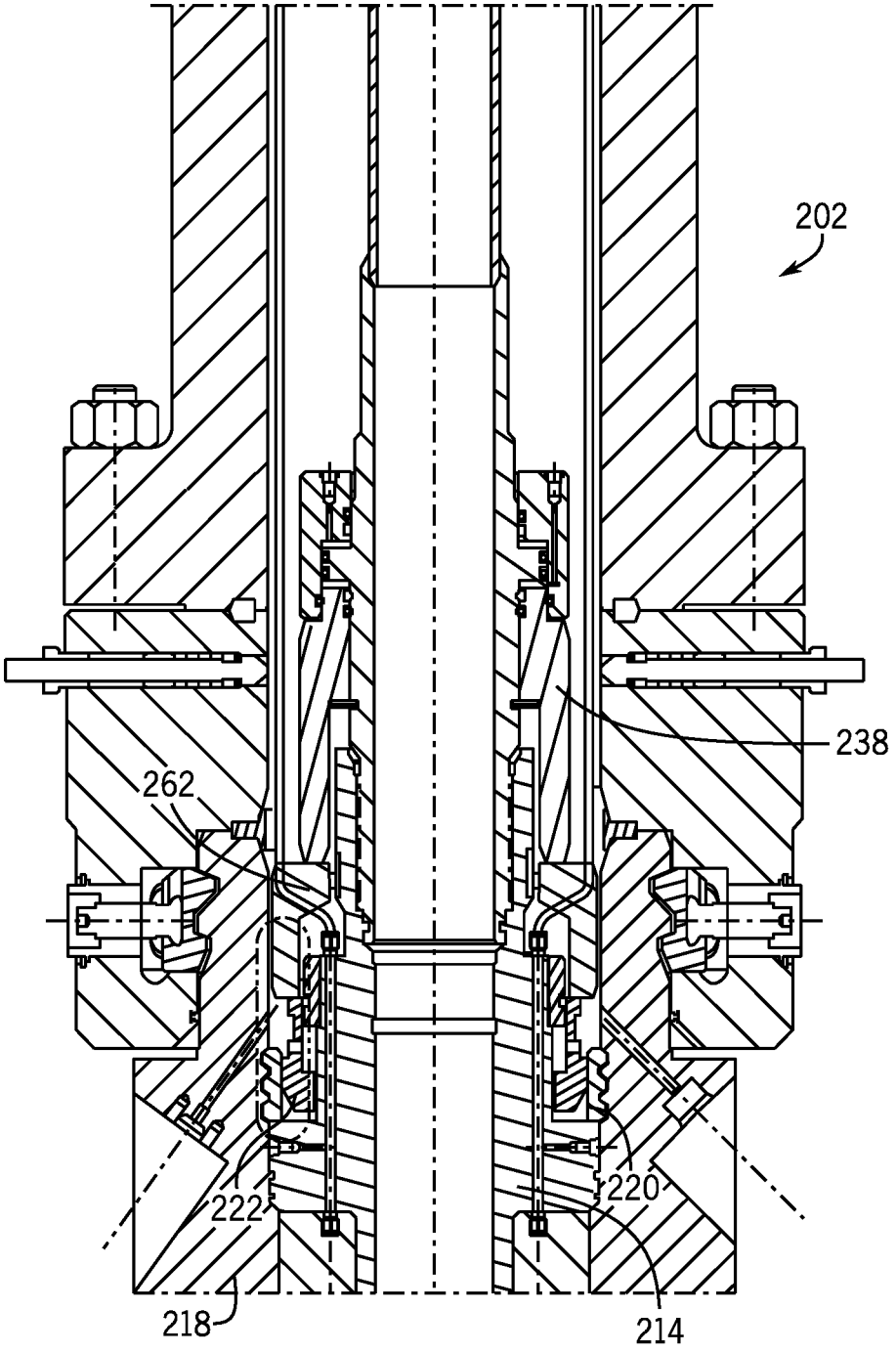
FIGS. 5A and 5B are schematic cross-sectional views of an embodiment of a hanger assembly in which a tubing hanger is in a post-installation position, in accordance with embodiments of the present disclosure.
Figure 5B:
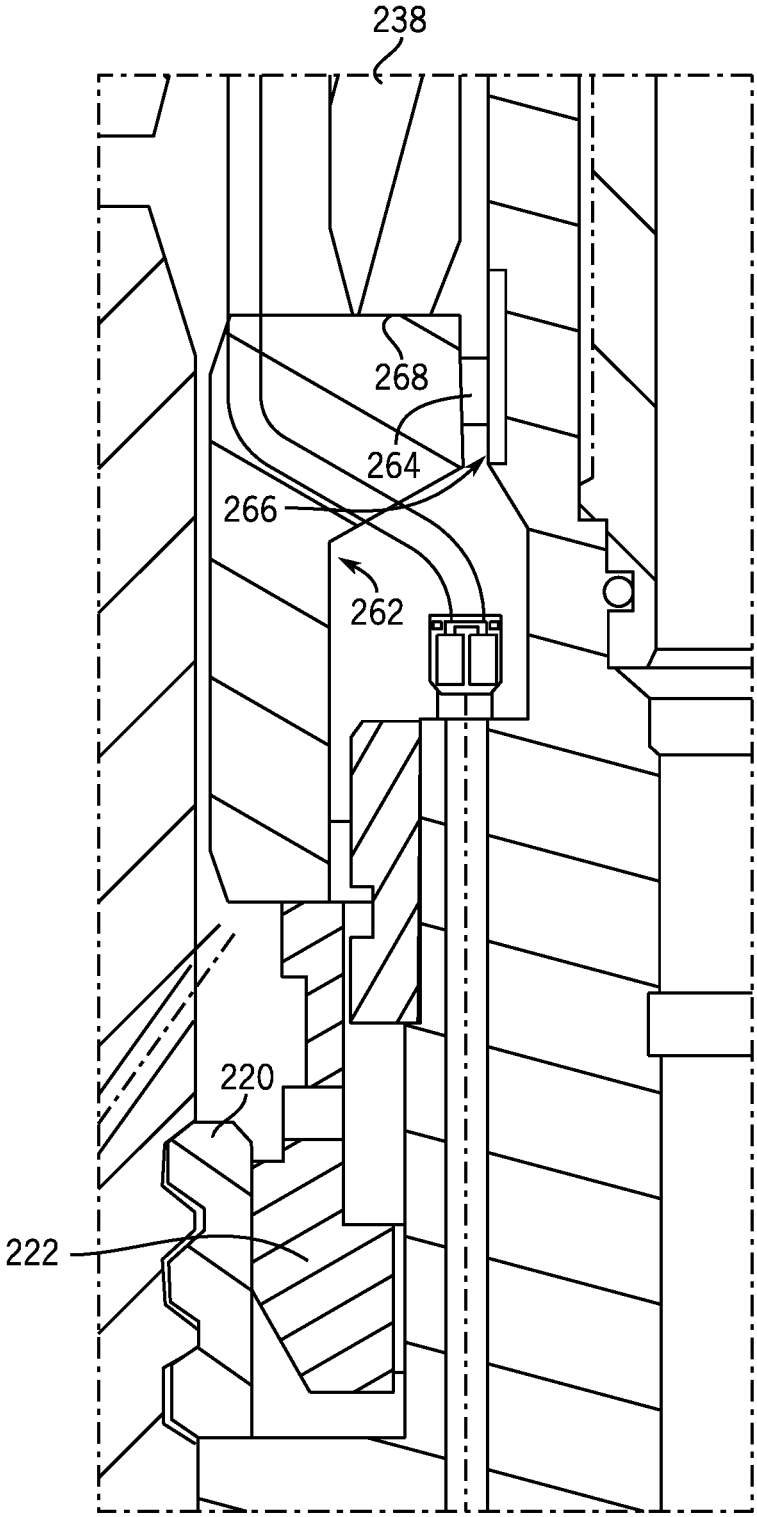
Figure 6A:
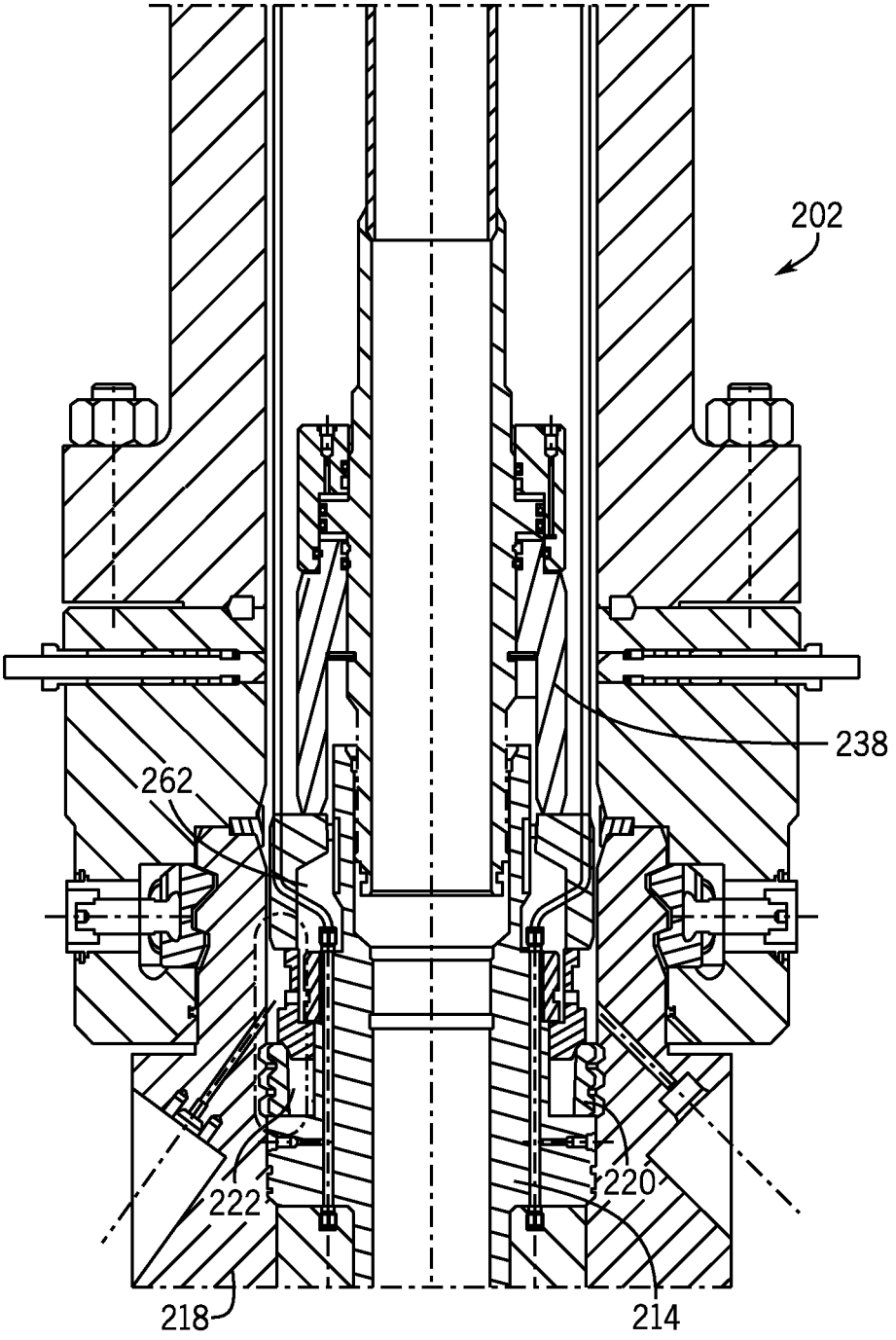
FIGS. 6A and 6B are schematic cross-sectional views of an embodiment of a hanger assembly in which a tubing hanger is in a pre-installation position, in accordance with embodiments of the present disclosure
Figure 6B:
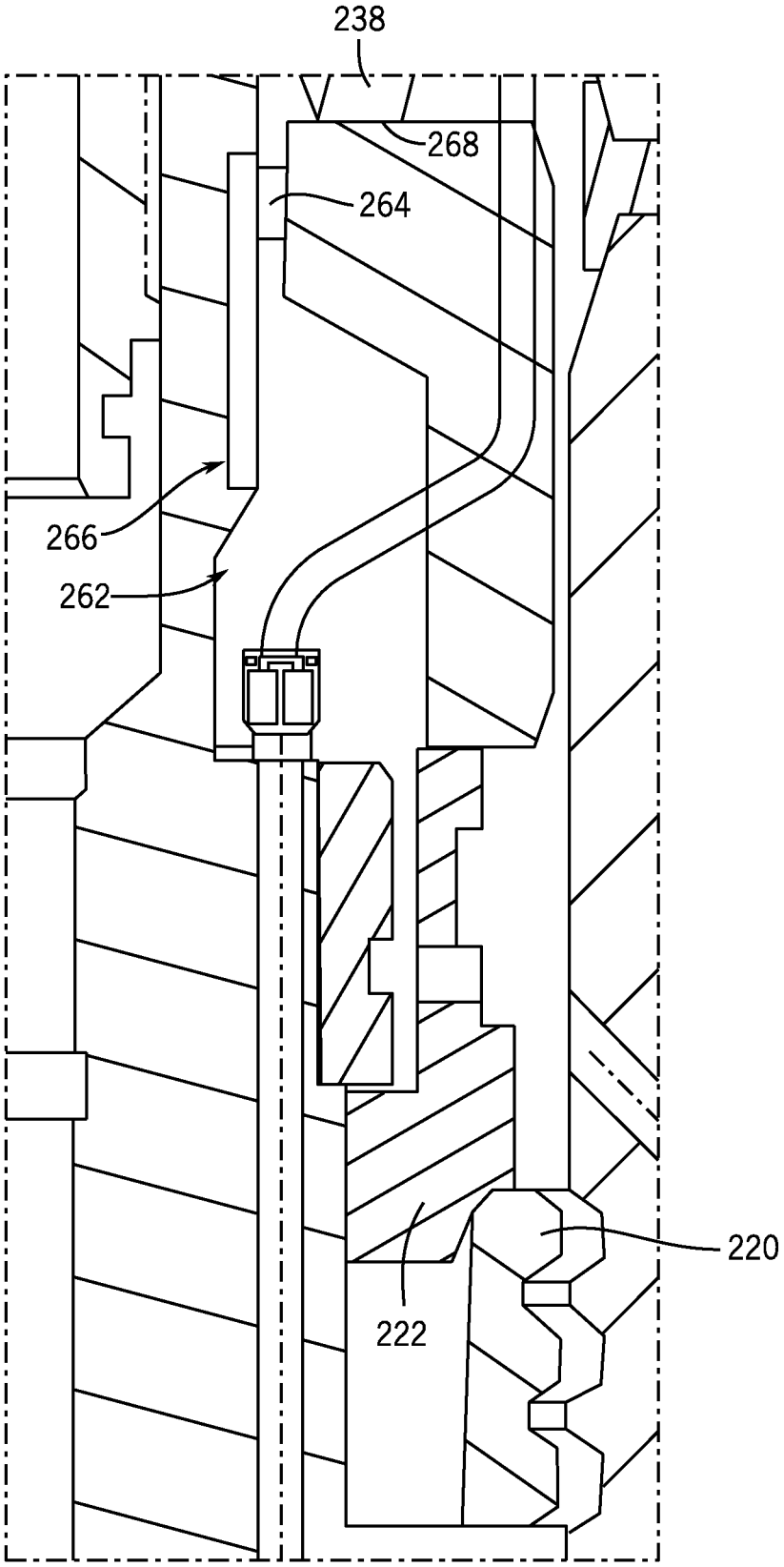

FIGS. 5A-6B illustrate a post-installation position (FIGS. 5A and 5B) and a pre-installation position (FIGS. 6A and 6B). As noted, in the pre-installation position, the tubing hanger 214 may not be locked or otherwise secured within the tubing head 218. In contrast, in the post-installation position, the tubing hanger 214 may be secured within the tubing head 218 via at least the lock ring 220.

In the illustrated example in FIGS. 6A and 6B, the anti-rotation bushing 262 is illustrated as resting on a top of the tubing hanger activation ring 222. Furthermore, the thrust collar 238 is shown along the activation surface 268 of the anti-rotation bushing 262. Additionally, the anti-rotation key 264 is shown within the anti-rotation keyway 266 near a top or axially higher position than in FIGS. 5A and 5B. For example, as shown in FIGS. 5A and 5B, after activation, the anti-rotation key 264 may travel axially downward along the anti-rotation keyway 266.

Further shown in FIGS. 6A and 6B is the tubing hanger activation ring 222 arranged, at least in part, radially inward with respect to a wellbore axis, of the lock ring 220. As described herein, downward force applied to the activation ring 222 is transmitted to the lock ring 220 such that the lock ring 220 is driven radially outward (from the wellbore axis) and into the tubing head 218, which may include slots or groove that correspond to a profile of the lock ring 220.

In the illustrated example in FIGS. 5A and 5B, the tubing hanger 214 is now in the post-installation position, as illustrated by the position of the lock ring 220 as engaging the tubing head 218. The anti-rotation bushing 262 is driven downward via the thrust collar 238 such that the anti-rotation key 264 travels axially downward along the anti-rotation keyway 266. It can be seen when comparing FIGS. 5B and 6B that the anti-rotation key 264 is axially lower (e.g., the anti-rotation key 264 is axially closer to the lock ring 220) when in the post-installation position. Further shown is the movement in the axial position of the tubing hanger activation ring 222, which is now radially inward of the lock ring 220 and also axially lower than in FIG. 6B. In this manner, the force of the thrust collar 238 may be transmitted to drive the lock ring 220 radially outward and into the tubing head 218, which locks the tubing hanger 214 in the post-installation position.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

a tubing hanger positioned within a wellhead, the tubing hanger being moveable between a locked position and an unlocked position, the tubing hanger including an activation ring and a lock ring, wherein the activation ring drives the lock ring radially outward to transition from the unlocked position to the locked position;

a hanger running tool coupled to the tubing hanger, the hanger running tool being moveable between a first position and a second position to apply an axial force to the activation ring, the hanger running tool comprising:

a mandrel coupled to the tubing hanger, the mandrel being mechanically coupled to the tubing hanger such that rotation of the mandrel axially drives the mandrel in a downhole direction;

a mandrel protrusion, the mandrel protrusion having a protrusion diameter larger than a mandrel diameter;

a thrust collar coupled to the mandrel, the thrust collar being driven axially in the downhole direction responsive to movement of the mandrel; and a hold down nut coupled to the mandrel;

a void cavity formed, at least in part, by the mandrel, the thrust collar, and the hold down nut, the void cavity positioned to receive the mandrel protrusion; and a bearing system positioned within the void cavity, the bearing system associated with the mandrel protrusion to enable rotation of the mandrel and to accommodate axial forces applied to the mandrel.

2. The wellbore system of claim 1, wherein the bearing system is a fluid bearing.

3. The wellbore system of claim 2, wherein the fluid bearing comprises:

an upper fill area within the void cavity axially higher than the mandrel protrusion; and a lower fill area within the void cavity axially lower than the mandrel protrusion.

4. The wellbore system of claim 3, further comprising:

a supply port fluidly coupled to at least one of the upper fill area or the lower fill area, the supply port positioned to direct a hydraulic fluid into the void cavity.

5. The wellbore system of claim 1, wherein the void cavity is a sealed cavity.

6. The wellbore system of claim 5, further comprising:

a first seal between the hold down nut and the mandrel;

a second seal between the hold down nut and the thrust collar; and a third seal between the mandrel and the thrust collar, wherein the first seal, the second seal, and the third seal block fluid ingress into the void cavity.

7. The wellbore system of claim 1, wherein the bearing system includes a mechanical bearing.

8. The wellbore system of claim 1, further comprising:

an anti-rotation bushing coupled to the tubing hanger, the anti-rotation bushing including one or more keys that engage one or more keyways of the tubing hanger.

9. The wellbore system of claim 8, wherein an axial load from the thrust collar is transmitted to the anti-rotation bushing and to the activation ring.

10. A hanger running tool for use with a wellbore system, comprising:

a mandrel having a first threaded portion at an upper end and a second threaded portion at a lower end, the second threaded portion to couple to a tubing hanger, wherein rotation of the mandrel with respect to the tubing hanger axially drives the mandrel in a downhole direction;

a mandrel protrusion, the mandrel protrusion extending radially outward from the mandrel to a protrusion diameter that is larger than a mandrel diameter;

a hold down nut coupled to the mandrel and arranged axially above the mandrel protrusion, the hold down nut including a profile that axially overlaps at least a portion of the mandrel protrusion and also radially surrounds at least a portion of the mandrel protrusion;

a thrust collar coupled to the mandrel and arranged axially below the mandrel protrusion, the thrust collar including a recess to receive at least a portion of the hold down nut;

a void cavity defined, at least in part, by the hold down nut, the thrust collar, and the mandrel, wherein the mandrel protrusion is positioned within the void cavity; and a bearing system positioned within the void cavity.

11. The hanger running tool of claim 10, wherein the thrust collar is coupled to the mandrel via a retainer ring.

12. The hanger running tool of claim 10, further comprising:

a first seal between the hold down nut and the mandrel;

a second seal between the hold down nut and the thrust collar; and a third seal between the mandrel and the thrust collar, wherein the combination of the first seal, the second seal, and the third seal form a fluid seal for the void cavity.

13. The hanger running tool of claim 10, wherein the bearing system is a fluid bearing.

14. The hanger running tool of claim 13, wherein the fluid bearing comprises:

an upper fill area between the hold down nut and the mandrel protrusion;

a lower fill area between the mandrel protrusion and the thrust collar; and a hydraulic fluid within at least portions of the upper fill area and the lower fill area;

wherein the hydraulic fluid supports the mandrel protrusion responsive to an axial force applied to the mandrel.

15. The hanger running tool of claim 14, wherein the upper fill area is approximately equal to the lower fill area.

16. The hanger running tool of claim 14, further comprising;

a protrusion seal positioned at the protrusion diameter, the protrusion seal engaging the hold down nut and blocking movement of hydraulic fluid between the upper fill area and the lower fill area.

17. The hanger running tool of claim 10, wherein the bearing system includes a thrust bearing.

18. A method, comprising:

coupling, via threaded connection, a hanger running tool to a tubing hanger to form a hanger assembly;

landing the hanger assembly in a wellhead;

filling a void cavity of the hanger running tool with a hydraulic fluid, the void cavity formed, at least in part, by a mandrel, a hold down nut, and a thrust collar;

rotating the mandrel of the hanger running tool, wherein rotating the mandrel causes downward movement of the mandrel along the threaded connection; and driving, via the downward movement of the mandrel, a hanger lock ring radially outward to engage one or more wellbore components of the wellhead.

19. The method of claim 18, further comprising:

coupling an anti-rotation bushing to the tubing hanger, the anti-rotation bushing including one or more keys to engage one or more keyways of the tubing hanger.

* * * * *